US008002265B2

(12) United States Patent
Suzuki

(10) Patent No.: US 8,002,265 B2
(45) Date of Patent: Aug. 23, 2011

(54) SHEET SUPPLY APPARATUS, SHEET SUPPLY UNIT AND IMAGE FORMING APPARATUS

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/635,810

(22) Filed: Dec. 11, 2009

(65) Prior Publication Data

US 2010/0148419 A1 Jun. 17, 2010

(30) Foreign Application Priority Data

Dec. 16, 2008 (JP) ..... 2008-319555

(51) Int. Cl.
*B65H 3/14* (2006.01)

(52) U.S. Cl. ..... 271/98; 271/97

(58) Field of Classification Search ..... 271/90, 271/93, 97, 98, 105, 30.1, 11
See application file for complete search history.

(56) References Cited

U.S. PATENT DOCUMENTS

| | | | | |
|---|---|---|---|---|
| 3,627,308 | A * | 12/1971 | Stoever | 271/104 |
| 6,955,348 | B2 * | 10/2005 | Koga | 271/97 |
| 7,913,993 | B2 * | 3/2011 | Kosugi et al. | 271/98 |
| 2004/0089994 | A1 * | 5/2004 | Koga et al. | 271/98 |

FOREIGN PATENT DOCUMENTS

| | | | |
|---|---|---|---|
| JP | 59149250 | A * | 8/1984 |
| JP | 2006-168933 | A | 6/2006 |

* cited by examiner

*Primary Examiner* — Jeremy Severson
(74) *Attorney, Agent, or Firm* — Cantor Colburn LLP

(57) ABSTRACT

A sheet supply apparatus including: a suction conveyance mechanism which suctions a topmost sheet of a plurality of sheets stacked and conveys the suctioned sheet to a sheet conveyance path; an outlet elevation mechanism which moves an air outlet to and from a first position at which the air outlet faces the side of the stacked sheets and a second position at which the air outlet faces a side of the sheet suctioned onto the suction surface; a suction detection sensor; a sheet supply detection sensor; and a control section which moves the air outlet to the first position or to the second position by controlling the outlet elevation mechanism based on detections by the sensors.

9 Claims, 7 Drawing Sheets

SHEET SUPPLY APPARATUS, SHEET SUPPLY UNIT AND IMAGE FORMING APPARATUS

CROSS REFERENCE TO RELATED APPLICATION

This application is based on Japanese Patent Application No. 2008-319555 filed on Dec. 16, 2008 in Japanese Patent Office, the entire content of which is hereby incorporated by reference.

BACKGROUND OF THE INVENTION

1. Field of Technology

The present invention relates to a sheet supply apparatus wherein an air jet is blasted to the edges of stacked sheets, which are suctioned to the suction surface made of a conveyance belt and others, whereby these sheets are fed out. The present invention relates particularly to a sheet supply apparatus wherein air outlet elevation control is performed in conformity to the result of detecting the presence or absence of a sheet suctioned to the suction surface.

2. Description of Related Art

A pneumatic sheet supply apparatus has been employed as the sheet supply apparatus for such an image forming apparatus as a photocopier. In the pneumatic sheet supply apparatus, an air jet is blasted to the lateral end faces of stacked sheets, and the sheet raised by air is suctioned to the suction surface such as a perforated belt wherein air inlets for suction of air are formed. The belt is driven to convey the sheet.

In the pneumatic sheet supply apparatus, if there is an air outlet above the upper side of the stacked sheets, a thick paper cannot be effectively raised because air jet fails to be blasted to the side of the sheet effectively, although a thin sheet can be raised.

On the other hand, if there is an air outlet below the upper side of the stacked sheets, a thick paper can also be raised. In the case of thin sheets, however, they tend to be raised as a bundle of sheets. When an air jet passes through the lower side of the raised bundle of sheets, the sheets cannot be easily separated from one another.

One of the proposals made to solve this problem is the technique wherein a mechanism for elevating an air outlet is used, and the elevation of an air outlet is controlled in conformity to the method of estimated control of time and others (Japanese Unexamined Patent Application Publication No. 2006-168933).

However, in the conventional pneumatic sheet supply apparatus, the air outlet is raised in conformity to estimated control. This involves a possible suction failure wherein sheets are not suctioned onto the suction surface, as well as possible multiple feed, wherein a plurality of sheets cannot be separated from one another, and the overlapped sheets are conveyed in the state of being suctioned onto the suction surface.

In view of the problems described above, it is an object of the present invention to provide a sheet supply apparatus wherein positive suction of sheets is ensured independently of the type thereof and the suctioned sheets can be separated from one another, a sheet supply unit provided with the aforementioned sheet supply apparatus, and an image forming apparatus.

SUMMARY OF THE INVENTION

One aspect of the present invention is a sheet supply apparatus comprising: a sheet loading table on which a plurality of sheets are stacked, wherein the sheet loading table moves up and down along a stacking direction of the plurality of sheets; a suction conveyance mechanism which suctions a topmost sheet of the plurality of sheets stacked on the sheet loading table onto an suction surface by suctioning a top surface of the stacked sheets and conveys the suctioned sheet to a sheet conveyance path; an air blast mechanism which comprises an air outlet which movies up and down along a direction in which a sheet of the stacked sheets on the sheet loading table are floated up toward the sheet suction surface and blasts air toward a side of the stacked sheets from the air outlet; an outlet elevation mechanism which moves the air outlet to and from a first position at which the air outlet faces the side of the stacked sheets on the sheet loading table and a second position at which the air outlet faces a side of the sheet suctioned onto the suction surface; a suction detection sensor which detects whether a sheet is suctioned to the suction surface or not; a sheet supply detection sensor which detects a sheet being conveyed by the suction conveyance mechanism; and a control section which judges a sheet raising operation time point when the sheets stacked on the sheet loading table are floated up and a sheet separation time point when the sheet suctioned to the suction surface is separated, based on a presence or non presence of the sheet suctioned to the suction face detected by the suction detection sensor and a conveyance position of the sheet detected by the sheet supply detection sensor, and moves the air outlet to the first position at the sheet raising operation time point and to the second position at the sheet separation time point by controlling the outlet elevation mechanism, based on the judgments of the operation time points.

Another aspect of the present invention is a sheet supply unit comprising: a sheet loading table on which a plurality of sheets are stacked, wherein the sheet loading table moves up and down along a stacking direction of the plurality of sheets; a suction conveyance mechanism which suctions a topmost sheet of the plurality of sheets stacked on the sheet loading table onto a suction surface by suctioning a top surface of the stacked sheets and conveys the suctioned sheet to a sheet conveyance path; an air blast mechanism which comprises an air outlet which movies up and down along a direction in which a sheet of the stacked sheets on the sheet loading table are floated up toward the sheet suction surface and blasts air toward a side of the stacked sheets from the air outlet; an outlet elevation mechanism which moves the air outlet to and from a first position at which the air outlet faces the side of the stacked sheets on the sheet loading table and a second position at which the air outlet faces a side of the sheet suctioned onto the suction surface; a suction detection sensor which detects whether a sheet is suctioned to the suction surface or not; a sheet supply detection sensor which detects a sheet being conveyed by the suction conveyance mechanism; and a control section which judges a sheet raising operation time point when the sheets stacked on the sheet loading table are floated up and a sheet separation time point when the sheet suctioned to the suction surface is separated, based on a presence or non presence of the sheet suctioned to the suction face detected by the suction detection sensor and a conveyance position of the sheet detected by the sheet supply detection sensor, and moves the air outlet to the first position at the sheet raising operation time point and to the second position at the sheet separation time point by controlling the outlet elevation mechanism, based on the judgments of the operation time points.

And another aspect of the present invention is image forming apparatus comprising: an image forming section for forming image on a sheet; a sheet supply apparatus for supplying a sheet to the image forming section; and a control section which executes a control to supply a sheet from the sheet supply apparatus to the image forming section and form image at the image forming section, wherein the sheet supply section comprises: a sheet loading table on which a plurality of sheets are stacked, wherein the sheet loading table moves up and down along a stacking direction of the plurality of sheets; a suction conveyance mechanism which suctions a topmost sheet of the plurality of sheets stacked on the sheet loading table onto a suction surface by suctioning a top surface of the stacked sheets and conveys the suctioned sheet to a sheet conveyance path; an air blast mechanism which comprises an air outlet which movies up and down along a direction in which a sheet of the stacked sheets on the sheet loading table are floated up toward the sheet suction surface and blasts air toward a side of the stacked sheets from the air outlet; an outlet elevation mechanism which moves the air outlet to and from a first position at which the air outlet faces the side of the stacked sheets on the sheet loading table and a second position at which the air outlet faces a side of the sheet suctioned onto the suction surface; a suction detection sensor which detects whether a sheet is suctioned to the suction surface or not; and a sheet supply detection sensor which detects a sheet being conveyed by the suction conveyance mechanism, wherein the judges a sheet raising operation time point when the sheets stacked on the sheet loading table are floated up and a sheet separation time point when the sheet suctioned to the suction surface is separated, based on a presence or non presence of the sheet suctioned to the suction face detected by the suction detection sensor and a conveyance position of the sheet detected by the sheet supply detection sensor, and moves the air outlet to the first position at the sheet raising operation time point and to the second position at the sheet separation time point by controlling the outlet elevation mechanism, based on the judgments of the operation time points.

DETAILED DESCRIPTION OF THE PREFERRED EMBODIMENTS

Referring to drawings, the following describes a sheet supply apparatus of the present invention, a sheet supply unit provided with this sheet supply apparatus, and an image forming apparatus embodiment connected with this sheet supply unit.

Figure 1:
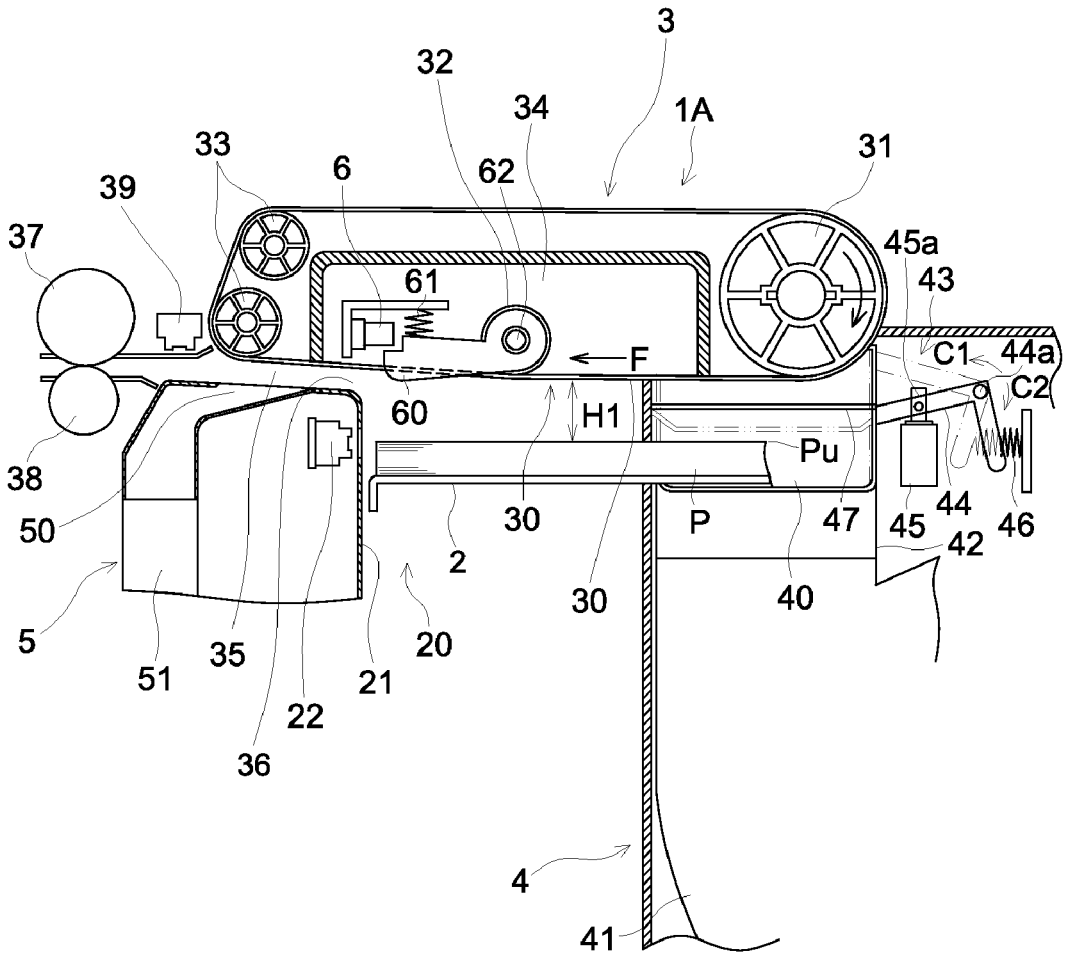
FIG. 1 is a side view showing an example of the sheet supply apparatus in the present embodiment.
Figure 2:
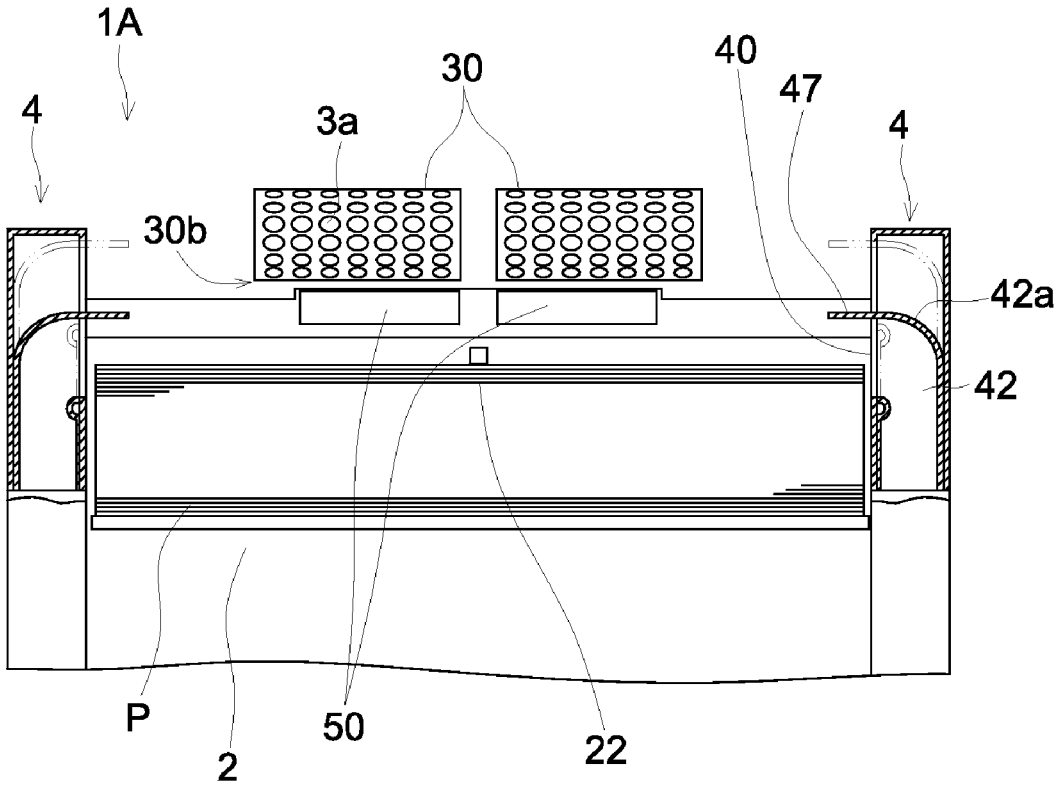
FIG. 2 is a front view showing an example of the sheet supply apparatus in the present embodiment.
Figure 3:
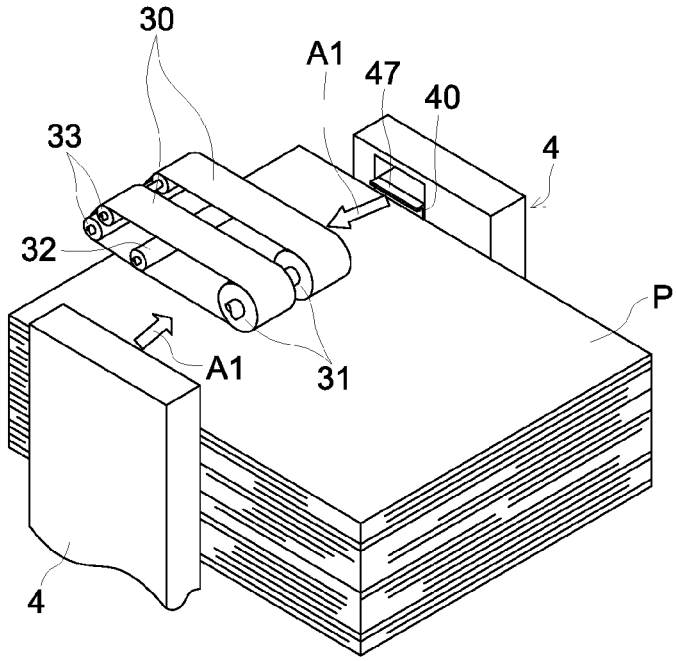
FIG. 3 is a perspective view of a sheet storage section representing an example of the sheet supply apparatus in the present embodiment.

Configuration Example of the Sheet Supply Apparatus in the Present Embodiment FIG. 1 is a side view showing an example of the sheet supply apparatus in the present embodiment. FIG. 2 is a front view showing an example of the sheet supply apparatus in the present embodiment;

FIG. 3 is a perspective view of a sheet storage section representing an example of the sheet supply apparatus in the present embodiment.

The sheet supply apparatus 1A of the present embodiment includes a suction conveyance mechanism 3 that suctions the sheets P stacked on a sheet loading table 2, and a sheet raising air blast mechanism 4 for blasting sheet raising air A1 to the sheets P stacked on the sheet loading table 2 from the side. The sheet supply apparatus 1A has a separation air blast mechanism 5 that blasts sheet separation air A2 to the sheets P suctioned by a suction conveyance mechanism 3, forwardly in the direction wherein the sheets P indicated by arrow F are conveyed.

The sheet supply apparatus 1A provides control in such a way as to change the height wherein the sheet raising air A1 is blasted, in conformance to the time point when the sheets P stacked on the sheet loading table 2 are raised, wherein this time point is determined according to whether or not sheets P have been suctioned by the suction conveyance mechanism 3, and where the sheets P fed out by the suction conveyance mechanism 3 are conveyed; and the time point when the sheets P suctioned on the suction conveyance mechanism 3 are separated from one another.

The following describes the details of the sheet supply apparatus 1A in the present embodiment: The sheet supply apparatus 1A includes a sheet loading table 2 provided on the sheet storage section 20 having a space formed to store a predetermined number of sheets P stacked thereon.

The sheet loading table 2 is moved vertically by an elevation mechanism (not illustrated) in the direction wherein sheets P are stacked. In the sheet storage section 20, the sheet leading-edge contact surface 21 that regulates the position of the leading edge of the sheets P stacked on the sheet loading table 2 is formed in the direction wherein the sheet loading table 2 is moved vertically.

The sheet supply apparatus 1A is provided with an upper limit detecting sensor 22 for detecting the upper side Pu of the sheets P stacked on the sheet loading table 2. The upper limit detecting sensor 22 is made of a pair of optical sensors for example, wherein the detection position is formed at a predetermined position of the sheet leading-edge contact surface 21 in the direction wherein sheets P are stacked. The upper limit detecting sensor 22 is arranged at the position wherein detection is made to make sure that the upper side Pu of the sheets P stacked on the sheet loading table 2 is located at the height H1 wherein sheets P can be suctioned by the suction conveyance mechanism 3. The upper limit detecting sensor 22 is so designed, for example, that the output is turned off if there is no sheet P at the height H1 wherein suction is possible, and the output is turned on if there are sheets P at the height H1 wherein suction is possible.

The sheet supply apparatus 1A provides control in such a way that the sheets P stacked on the sheet loading table 2 are fed out by the suction conveyance mechanism 3, whereby the height of the sheets P stacked on the sheet loading table 2 is decreased. Then the sheet loading table 2 is moved up to the position wherein the upper side Pu of the sheets P is detected by the upper limit detecting sensor 22. The upper side Pu of the sheets P stacked on the sheet loading table 2 reaches the height H1 wherein sheets P can be suctioned by the suction conveyance mechanism 3.

The suction conveyance mechanism 3 includes a conveyance belt 30 mounted above the sheet storage section 20. Further, the suction conveyance mechanism 3 is provided with a drive roller 31 wound with the conveyance belt 30, a first driven roller 32, and a second driven roller group 33 equipped with two driven rollers.

The conveyance belt 30 is endless, and air inlets 30*a* penetrating the conveyance belt 30 are arranged across the width of the conveyance belt 30. A plurality of the air inlets 30*a* arranged across the width of the conveyance belt 30 are formed along the entire length perpendicular to the width of the conveyance belt 30.

The drive roller 31 has a shaft in the direction perpendicular to the direction wherein the sheets P are conveyed, as indicated by arrow F, and is driven by a motor (to be described later). The first driven roller 32 and the second driven roller group 33 are provided with shafts parallel to that of the drive roller 31, and are designed in such a freely rotatable structure as to be driven by the rotation of the conveyance belt 30 resulting from rotation of the drive roller 31.

In the suction conveyance mechanism 3, the second driven roller group 33 is located before the sheet leading-edge contact surface 21 with reference to the sheet-P traveling direction indicated by arrow F. The drive roller 31 is arranged above the sheet loading table 2. Further, the first driven roller 32 is mounted above the sheet loading table 2 between the second driven roller group 33 and drive roller 31.

In the suction conveyance mechanism 3, conveyance belt 30 is applied in the sheet-P traveling direction between the drive roller 31 and second driven roller group 33. Thus, the suction conveyance mechanism 3 on the side of the trailing edge wherein the conveyance belt 30 is applied to the drive roller 31 is located above the sheets P stacked on the sheet loading table 2. The suction conveyance mechanism 3 on the side of the leading edge wherein the conveyance belt 30 is applied to the second driven roller group 33 is located before the sheet leading-edge contact surface 21. Further, in the suction conveyance mechanism 3, two conveyance belts 30 are arranged in parallel on the right and left in the sheet-P traveling direction.

When the drive roller 31 is driven in the arrow-marked direction, each conveyance belt 30 is rotated and the side of the conveyance belt 30 facing the sheet loading table 2 moves in the sheet-P traveling direction indicated by arrow F.

The bottom end of the drive roller 31 in the circumferential surface is located at almost the same height as the bottom end of the first driven roller 32 in the circumferential surface. By contrast, the bottom end of the lower driven roller out of the second driven roller group 33 in the circumferential surface is higher than the bottom end of the first driven roller 32 by a predetermined amount.

Thus, between the drive roller 31 and the first driven roller 32, the side of the conveyance belt 30 facing the sheet loading table 2 is approximately in parallel to the surface of the sheets P stacked on the sheet loading table 2. By contrast, an upward inclination in the sheet-P traveling direction is found between the first driven roller 32 and second driven roller group 33, and the conveyance belt 30 is bent at the portion wound on the first driven roller 32.

The suction conveyance mechanism 3 includes a suction chamber 34 wherein the air for suctioning sheets P to the conveyance belt 30 is drawn. In the suction chamber 34, the space wherein air is drawn by a fan (not illustrated) is formed inside the conveyance belt 30, and the lower side opposed to the conveyance belt 30 positioned on the side facing the sheet loading table 2 is opened. Thus, air is drawn in through the air inlet 30*a* of the conveyance belt 30 on the side facing the sheet loading table 2.

In the suction conveyance mechanism 3, when the air of the suction chamber 34 has been drawn by a fan (not illustrated), the suction chamber 34 has a negative pressure. This allows air to be drawn through the air inlet 30*a* of the conveyance belt 30 located at the side facing the sheet loading table 2. An air flow for suctioning sheets P is produced on the conveyance belt 30 on the side facing the sheet loading table 2.

Thus, a suction surface 30*b* for suctioning the sheets P is formed on the conveyance belt 30 on the side facing the sheet loading table 2 wherein air is drawn into the suction chamber 34 through the air inlet 30*a*.

The sheet supply apparatus 1A includes a sheet conveyance path 35 wherein the sheets P fed out by the suction conveyance mechanism 3 are conveyed. The sheet conveyance path 35 includes a guide member that guides the conveyance of the sheets P suctioned and fed out by the suction conveyance mechanism 3. A sheet inlet 36 to allow entry of the sheets P is formed between the conveyance belt 30 on the side facing the sheet loading table 2 and the top end of the sheet leading-edge contact surface 21.

The sheet supply apparatus 1A includes a conveyance roller 37 on the sheet conveyance path 35, and a driven roller 38 opposed to the conveyance roller 37. The conveyance roller 37 is rotated by a motor (to be described later). The sheets P fed out by the suction conveyance mechanism 3 are sandwiched by the conveyance roller 37 and driven roller 38, and are conveyed.

The sheet supply apparatus 1A includes a sheet supply detection sensor 39 installed on the sheet conveyance path 35. The sheet supply detection sensor 39 is composed of a pair of optical sensors, for example, wherein the detection position is formed upstream of the conveyance roller 37 and driven roller 38. The sheet supply detection sensor 39 detects the sheets P fed out by the suction conveyance mechanism 3 and conveyed by the conveyance roller 37. When the leading edge of the sheets P fed out by the suction conveyance mechanism 3 has arrived, the output of the sheet supply detection sensor 39 is turned on, for example. The output is turned off when the trailing edge of the sheets P conveyed by the conveyance roller 37 has passed away.

The sheet raising air blast mechanism 4 is an example of the air blasting mechanism. A sheet raising air outlet 40 is formed as an air outlet on the side of the sheet storage section 20. In the sheet raising air blast mechanism 4, the air drawn in by the air blast fan 41 is blasted out of the sheet raising air outlet 40 as the sheet raising air A1.

The sheet supply apparatus 1A has an outlet forming duct 42 provided upstream in the air blasting direction wherein air is blasted by the air blast fan 41. The outlet forming duct 42 is an example of the outlet forming section material, and includes an air way forming section 42*a* formed on the inner surface of the arc-shaped curved surface, as shown in FIG. 2. This air way ensures that the air blasted upward from the air blast fan 41 is changed to flow in the horizontal direction.

In the outlet forming duct 42, the sheet raising air outlet 40 opened toward the side is formed downstream of the air way forming section 42*a*. The outlet forming duct 42 is supported by a guide member (not illustrated) in such a way that the outlet forming duct 42 can be moved in the vertical direction in the direction wherein the sheets P are raised, whereby the height of the sheet raising air outlet 40 is changed.

The sheet supply apparatus 1A has an outlet elevation mechanism 43 that moves the outlet forming duct 42 in the vertical direction. The outlet elevation mechanism 43 includes a link member 44 connected to the outlet forming duct 42, a solenoid 45 for causing vertical movement of the outlet forming duct 42 through the link member 44, and a spring 46 that energizes the link member 44.

The link member 44 rotates about the fulcrum 44*a*. The rotation of the link member 44 is converted to the vertical movement of the outlet forming duct 42. In the solenoid 45, the movable element 45*a* that is displaced by the flow of the drive current to a coil (not illustrated) is connected to the link member 44. When the solenoid 45 is driven, the movable element 45*a* is pulled inside and the spring 46 is compressed, so that the link member 44 rotates about the fulcrum 44*a* in the direction marked by arrow C1.

When the link member 44 has rotated in the direction of C1, the outlet forming duct 42 connected to the link member 44 is moved downward. When the solenoid 45 is driven by this operation, the sheet raising air outlet 40 moves to the sheet raising position, which is the first position indicated by the solid lines of FIGS. 1 and 2.

The sheet raising air outlet 40 having moved to the sheet raising position is located on the side of the sheets P stacked on the sheet loading table 2. In the sheet raising air blast mechanism 4, the sheet raising air outlet 40 is moved and the sheet raising air A1 is blasted, sheet raising air A1 is blasted from the side to the sheets P stacked on the sheet loading table 2, whereby sheets P are raised by the sheet raising air A1.

If when the operation of the solenoid 45 has been suspended, the suction of the movable element 45*a* is turned off and the link member 44 is driven by the elastic force of the spring 46 in the direction indicated by arrow C2. When the link member 44 has rotated in the direction C2, the outlet forming duct 42 connected to the link member 44 moves upward. When the operation of the solenoid 45 has been turned off as a result of this procedure, the sheet raising air outlet 40 moves to the separation position, the second position indicated by the two-dot chain lines of FIGS. 1 and 2.

The sheet raising air outlet 40 having moved to the separation position is positioned on the side of the sheets P suctioned to the conveyance belt 30 constituting the suction surface 30*b*. In the sheet raising air blast mechanism 4, when the sheet raising air outlet 40 has been moved to the separation position and the sheet raising air A1 has been blasted, sheet raising air A1 is blasted from the side to the sheets P suctioned to the conveyance belt 30. When two or more sheets have been suctioned to the conveyance belt 30, these sheets are separated from one another.

The sheet raising air blast mechanism 4 has a sheet holding flap 47 mounted on the sheet raising air outlet 40. The sheet holding flap 47 is an example of the sheet holding member. The tabular member projecting from the sheet raising air outlet 40 to the side is mounted on the top end of the sheet raising air outlet 40. When the sheets P stacked on the sheet loading table 2 is raised by sheet raising air A1, the sheet holding flap 47 is projected from the sheet raising air outlet 40 to the side by a predetermined length so as to come in contact with the side of the sheets P. Interlocked with the vertical movement of the outlet forming duct 42, the sheet holding flap 47 moves in the vertical direction.

The separation air blast mechanism 5 has a sheet separation air outlet 50 that allows the sheet separation air A2 to be blasted out of the sheet inlet 36. In the separation air blast mechanism 5, the air drawn in by the air blast fan 51 is blasted to the sheet storage section 20 obliquely to the conveyance belt 30 from the sheet separation air outlet 50. The sheet separation air A2 blasted from the sheet separation air outlet 50 is directed upward to conform to the conveyance belt 30 on the side facing the sheet loading table 2, is blasted approximately in the horizontal direction to the sheet P from the front side of the sheets P suctioned to the conveyance belt 30.

The sheet supply apparatus 1A includes a suction detection sensor 6 that detects the presence or absence of the sheets P suctioned to the conveyance belt 30 by the suction conveyance mechanism 3. The suction detection sensor 6 is made up of a pair of optical sensors, for example, and detects the presence or absence of the detector 60 displaced by being pushed up by the sheets P suctioned to the conveyance belt 30 by the suction conveyance mechanism 3. To be more specific, when the sheets P have been suctioned to the conveyance belt 30 by the suction conveyance mechanism 3, a force is applied to push up the detector 60 projecting from the suction surface 30*b* made up of the conveyance belt 30. When the force is applied to push up the detector 60, the spring 61 is subjected to elastic deformation. Then the detector 60 rotates about the axis 62, and is displaced in the direction of storage with reference to the suction surface 30*b*.

When there is no more sheet P to be suctioned to the conveyance belt 30, the force to push up the detector 60 ceases to be applied. The detector 60 is rotated about the axis 62 by the elastic force of the spring 61, and is displaced in the direction of projecting toward the suction surface 30*b*.

As described above, the detector 60 is rotated and displaced according to the presence or absence of the sheets P suctioned to the conveyance belt 30 by the suction conveyance mechanism 3. When sheets P are not suctioned to the conveyance belt 30, the output of the suction detection sensor 6 is turned off. When sheets P are suctioned to the conveyance belt 30, the output is turned on. Thus, from the output of the suction detection sensor 6, it is possible to determine if the sheets P are suctioned to the conveyance belt 30 or not.

Figure 4:
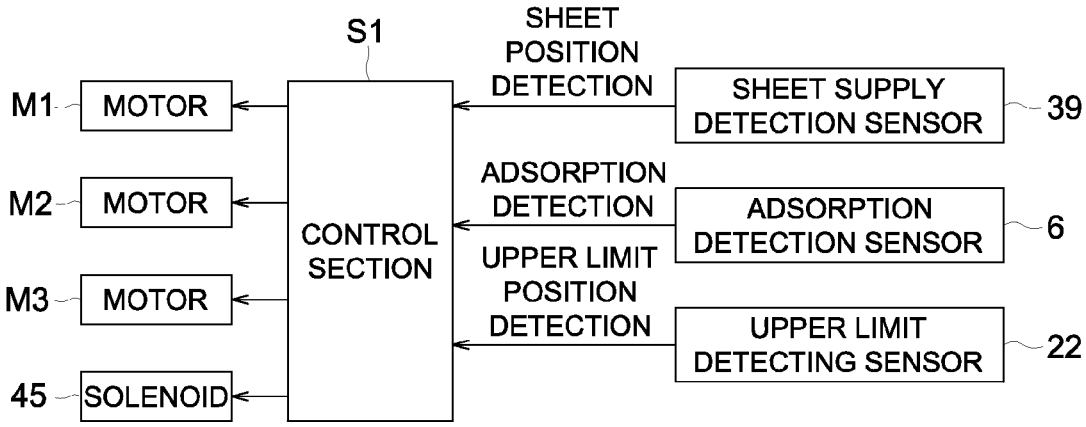
FIG. 4 is a functional block diagram representing an example of the control system of the sheet supply apparatus in the present embodiment.

FIG. 4 is a functional block diagram representing an example of the control system of the sheet supply apparatus in the present embodiment. The sheet supply apparatus 1A includes the control section S1 that provides the sheet supply control in such a way that the sheets P stacked on the sheet loading table 2 as described with reference to FIG. 1 are fed out one by one, based on the output of each sensor. The control section S1 can be made of the control section of the image forming apparatus to be described later.

Based on the output of the suction detection sensor 6, the control section S1 detects that the sheets P have been suctioned to the conveyance belt 30 by the suction conveyance mechanism 3 shown in FIG. 1. From the output of the sheet supply detection sensor 39, the control section S1 detects that the leading edges and the trailing edges of the sheets P fed out by the suction conveyance mechanism 3 have reached a predetermined position.

Based on the presence or absence of the sheets P suctioned to the conveyance belt 30 detected by the suction detection sensor 6 and the conveyance position of the sheets P detected by the sheet supply detection sensor 39, the control section S1 changes the height of the sheet raising air outlet 40. The height of the sheet raising air outlet 40 is changed to either the sheet raising position or sheet separation position by the upward movement of the outlet forming duct 42 under the control of the operation and non-operation mode of the solenoid 45.

Based on the presence or absence of the sheets P suctioned to the conveyance belt 30 detected by the suction detection sensor 6 and the conveyance position of the sheets P detected by the sheet supply detection sensor 39, the control section S1 controls the motor M1 for driving the conveyance belt 30 and the motor M2 for driving the conveyance roller 37.

According to the upper side of the sheets P detected by the upper limit detecting sensor 22, the control section S1 controls the motor M3 for moving the sheet loading table 2 in the vertical direction so that the upper side Pu of the sheets P stacked on the sheet loading table 2 is adjusted to the height H1 that allows the sheet to be supplied.

Operation Example of the Sheet Supply Apparatus in the Present Embodiment

Figure 5A:
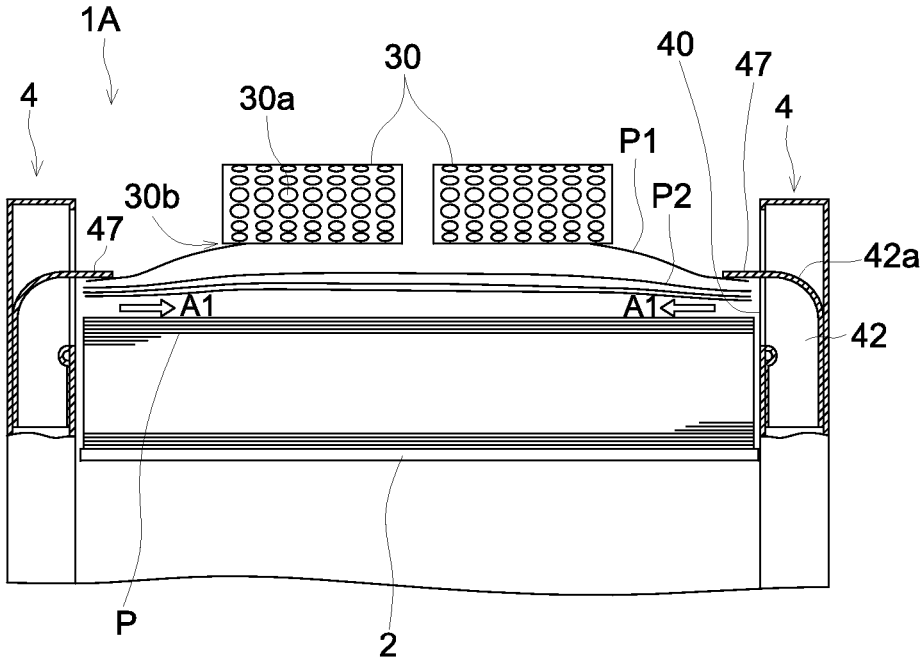
FIGS. 5*a* and 5*b* are front views showing an operation example of the sheet supply apparatus in the present embodiment.
Figure 5B:
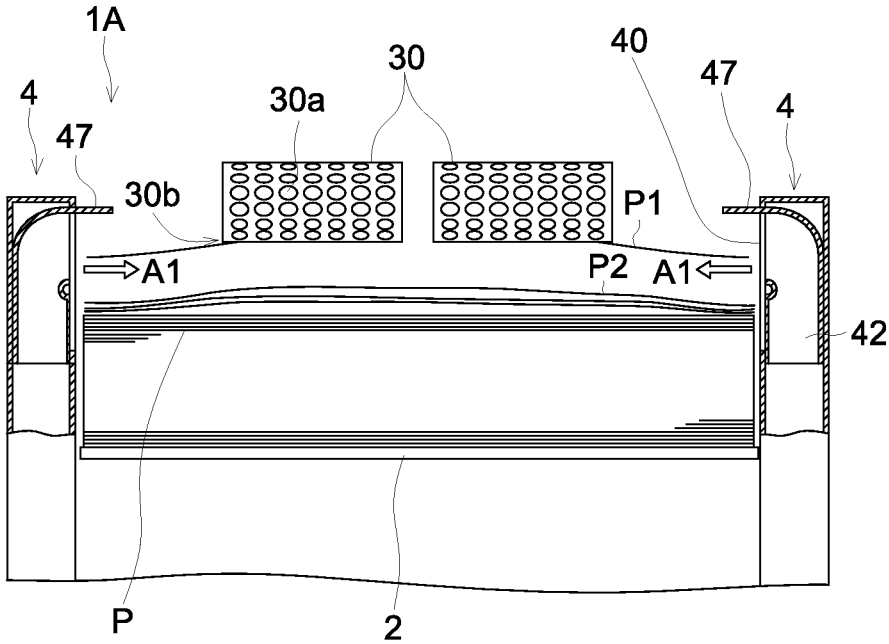
Figure 6:
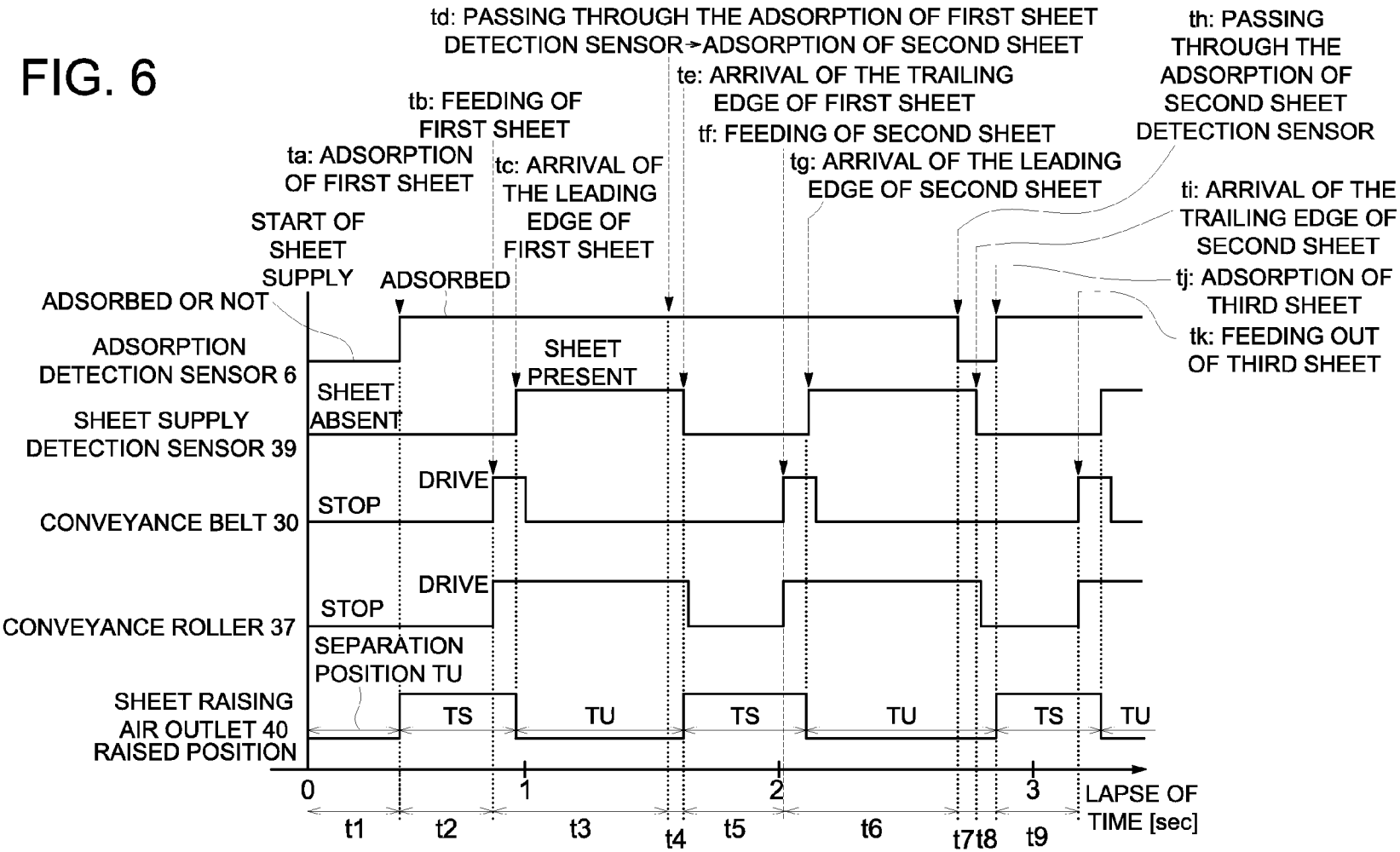
FIG. 6 is a time chart showing an operation example of the sheet supply apparatus in the present embodiment.

FIGS. 5*a* and 5*b* are front views showing an operation example of the sheet supply apparatus in the present embodiment. FIG. 6 is a time chart showing an operation example of the sheet supply apparatus in the present embodiment. Referring to these drawings, the following describes the operation example of the sheet supply apparatus 1A of the present embodiment.

When sheet supply operation has started, according to the output of the upper limit detecting sensor 22, the control section S1 controls the motor M3 that moves the sheet loading table 2 in the vertical direction in such a way that the upper side Pu of the sheets P stacked on the sheet loading table 2 will reach the height H1 that allows suction by the suction conveyance mechanism 3.

In the supply of sheets P, the fan (not illustrated) of the suction conveyance mechanism 3 is driven. At the same time, the air blast fan 41 of the sheet raising air blast mechanism 4 and the air blast fan 51 of the separation air blast mechanism 5 are driven, so that sheets P are raised and suctioned, in the first place.

In the process of the sheets P being raised and suctioned, if it has been determined, from the output of the suction detection sensor 6, that the sheets P are not suctioned to the conveyance belt 30, the control section S1 drives the solenoid 45, and lowers the sheet raising air outlet 40 to the sheet raising position shown in FIG. 5*a*.

When the air of the suction chamber 34 has been drawn in by the fan (not illustrated), the pressure of the suction chamber 34 turns negative. This allows air to be drawn in from the air inlet 30*a* of the conveyance belt 30 located on the side facing the sheet loading table 2, and produces a flow of air for suctioning sheets P to the conveyance belt 30 on the side facing the sheet loading table 2.

In the sheet raising air blast mechanism 4, the air blast fan 41 is driven with the sheet raising air outlet 40 lowered to the sheet raising position, and the sheet raising air A1 is blasted from the sheet raising air outlet 40. This allows the sheet raising air A1 to be blasted from the side of the sheets P stacked on the sheet loading table 2.

Then, for the sheets P stacked on the sheet loading table 2, the sheets P stacked on the upper side start to arise. The time t1 of FIG. 6 indicates the standby time between the start of sheet supply operation and the suction of the raised sheets P to the conveyance belt 30, and is the sheet raising operation time point TU to be determined from the output of the suction detection sensor 6.

The sheet P at the topmost position stacked on the sheet loading table 2 is suctioned to the conveyance belt 30 constituting the suction surface 30*b* at the time point to given in FIG. 6. When the sheet P has been suctioned to the conveyance belt 30, the detector 60 constituting the suction detection sensor 6 is pushed up by the force that suctions the sheet P. The spring 61 is subjected to elastic deformation, and the detector 60 rotates about the axis 62.

Thus, the detector 60 is detected by the suction detection sensor 6 at the time point to of FIG. 6. When the output of the suction detection sensor 6 has been turned on (sheet suctioned), the control section S1 assumes that the sheet P (the first sheet P in this case) is suctioned to the conveyance belt 30.

After having detected that the sheet P is suctioned to the conveyance belt 30, the control section S1 checks the output of the suction detection sensor 6 to determine that the sheet separation time point TS has been reached. The control section S1 turns off the solenoid 45, and allows the sheet raising air outlet 40 to move upward to the sheet separation position shown in FIG. 5*b*. Then the next step is taken to start the sheet-P separation and conveyance operation.

The sheet raising air outlet 40 is kept at the sheet raising position until the sheet raising air outlet 40 checks the output of the suction detection sensor 6 to determine that the sheet P has been suctioned to the conveyance belt 30. Even when thick paper is set on the sheet loading table 2, the sheet raising air A1 is effectively blasted to the side of the sheets P stacked on the sheet loading table 2, whereby positive raising of the sheet P is ensured. This arrangement prevents the un-suctioned paper from being jammed, independently of the type of the sheets P stacked on the sheet loading table 2.

The sheet raising air outlet 40 is kept at the sheet raising position until the sheet P is suctioned to the conveyance belt 30. This arrangement ensures that the side of the sheet P raised by the sheet raising air A1 is held in the downward position by the sheet holding flap 47. When thin sheets are set on the sheet loading table 2, a plurality of sheets P tend to arise as a bundle if the sheet raising air A1 is blasted from the side of the sheet P. In this case, the side of the sheet P raised by the sheet raising air A1 is held in the downward position by the sheet holding flap 47. This arrangement prevents the second and later sheets P 2 to be raised, except the first sheet P1 at the topmost position suctioned to the conveyance belt 30. This suppresses suction of a plurality of sheets P being suctioned to the conveyance belt 30.

The conveyance belt 30 located on the side facing the sheet loading table 2 is bent at the portion wound on the first driven roller 32, and the conveyance belt 30 arranged between the first driven roller 32 and second driven roller group 33 is upwardly inclined in the sheet-P traveling direction. This arrangement ensures that the sheet P suctioned to the conveyance belt 30 is bent at the portion wherein the conveyance belt 30 is wound on the first driven roller 32.

When two or more sheets P have been suctioned to the conveyance belt 30, a plurality of sheets P are stuck fast on the belt by static electricity or others. Since the suction power by suction air directly acts on the one sheet at the topmost position suctioned to the conveyance belt 30, this sheet is suctioned to the conveyance belt 30 as the sheet is bent conforming to the portion wherein the conveyance belt 30 is wound on the first driven roller 32.

By contrast, the suction power of air does not directly act on the second and later sheets stuck on the sheet at the topmost position and suctioned to the conveyance belt 30. Thus, the second and later sheets do not conform to the bent form of the conveyance belt 30 at the portion wherein the belt is wound on the first driven roller 32. Instead, the first sheet at the topmost position is separated from the second and later sheets at the leading edge surfaces.

In the separation air blast mechanism 5, the air blast fan 51 is driven and the sheet separation air A2 blasted from the sheet separation air outlet 50 is directed to conform to the conveyance belt 30 on the side facing the sheet loading table 2. The sheet separation air A2 is blasted approximately in the horizontal direction to the sheet P from the front of the sheet P suctioned on the conveyance belt 30.

Further, in the sheet raising air blast mechanism 4, blasting of the sheet raising air A1 is still in progress and the sheet raising air outlet 40 is moved upward. When the sheet raising air A1 has been blasted, the sheet raising air A1 is blasted from the side to the sheet P suctioned to the conveyance belt 30.

When two or more sheets P have been suctioned in the suction conveyance mechanism 3, the first sheet P1 at the topmost position is separated from the second and later sheets P2 by the sheet separation air A2 blasted from the front of the sheet P suctioned to the conveyance belt 30 and the sheet raising air A1 blasted from the side of the sheet P suctioned on the conveyance belt 30 from the sheet raising air outlet 40 moved up to the separation position.

Even when thin sheets are set on the sheet loading table 2, and thin sheets have been raised as a bundle in the sheet raising and suction operation, sheet raising air A1 is blasted from the sheet raising air outlet 40 at the sheet separation position, whereby the sheet raising air A1 is allowed to pass through the space between the first sheet P1 at the topmost position and second and later sheets P2 having been suctioned to the conveyance belt 30.

Thus, the sheets P having been raised as a bundle are separated by the sheet raising air A1 from the one sheet at the topmost position suctioned to the conveyance belt 30. This arrangement prevents a jam from being caused by multiple feed at the time of conveyance, independently of the type of the sheets P stacked on the sheet loading table 2.

The sheet raising air outlet 40 checks the output of the suction detection sensor 6, and detects that the sheets P has been suctioned to the conveyance belt 30. After that, the sheet raising air outlet 40 moves up to the separation position. This arrangement prevents the sheet raising air outlet 40 from moving to the separation position before the sheets P is suctioned to the conveyance belt 30. This prevents sheet raising air A1 from being effectively blasted to the side of the sheets P stacked on the sheet loading table 2 before the sheets P is suctioned to the conveyance belt 30, and prevents an unsuctioned jam from being caused by the failure of the sheet P to be raised.

When the sheets P have been suctioned to the conveyance belt 30, the sheet raising air outlet 40 is moved up to the separation position. In the process of separating and conveying the sheets P, the sheet holding flap 47 can be made to retract. When a thick paper is set on the sheet loading table 2, the sheets P may be separated from the conveyance belt 30 if the sides of the sheets P suctioned to the conveyance belt 30 are held in a downward direction by the sheet holding flap 47. Further, an excessive load will be applied when the sheets P are conveyed, as will be described later. Thus, in the process of separating and conveying the sheets P, the sheet holding flap 47 is made to retract. When the sheet raising air outlet 40 is provided with a sheet holding flap 47, the vertical movement of the sheet holding flap 47 can be interlocked with that of the sheet raising air outlet 40. This eliminates the need of installing an independent drive mechanism for vertical movement of the sheet holding flap 47, and permits the structure and control to be simplified.

In the sheet supply apparatus 1A of the present embodiment, the sheet raising air outlet 40 is lowered to the sheet raising position before the sheets P are suctioned to the conveyance belt 30. The sheet raising air outlet 40 is moved up to the separation position after the sheets P have been suctioned to the conveyance belt 30. This arrangement ensures compatibility between the raising of the sheets P and separation of the sheets P, despite the constant volume of the sheet raising air A1. It is also possible to arrange such a configuration that the volume of the sheet raising air A1 blasted by the sheet raising air blast mechanism 4 can be selected by the switch of a shutter (not illustrated), and sheet raising air A1 is blasted in the high volume mode before the suction of the sheets P is detected by the suction detection sensor 6. When the suction of the sheets P has been detected by the suction detection sensor 6, the low air volume is selected, whereby the sheet raising air A1 is blasted.

The time t2 of FIG. 6 is defined as the duration of sheet separation standby time, from the time when the output of the suction detection sensor 6 is turned on at the time point to and detection is made to verify that the sheets P have been suctioned to the conveyance belt 30, to the time when the sheets P are separated by the action of the sheet separation air A2 and sheet raising air A1, as described above.

When the output of the suction detection sensor 6 is turned on at the time point to and detection is made to verify that the sheets P have been suctioned to the conveyance belt 30, the control section S1 allows the drive roller 31 of the suction conveyance mechanism 3 to be driven by the motor M1 at the time point tb when a predetermined sheet separation standby time t2 has elapsed. At the same time, the control section S1 allows the conveyance roller 37 to be driven by the motor M2, whereby the conveyance of sheets P starts.

When the drive roller 31 has been driven in the arrow marked direction, the conveyance belt 30 is rotated and the side of the conveyance belt 30 facing the sheet loading table 2 moves in the direction indicated by arrow F. This arrangement ensures that the sheets P suctioned to the conveyance belt 30 by the suction conveyance mechanism 3 are fed out in the direction of conveyance indicated by arrow F. In the process of conveying the sheets P, blasting of the sheet separation air A2 by the separation air blast mechanism 5 is still in progress. This gives rise to the force for ensuring that the second and later sheets P having been separated is moved back to the sheet storage section 20. This arrangement prevents the second sheet P from being conveyed to the sheet inlet 36 under the influence of movement of the first sheet P.

When the sheets P suctioned by the suction conveyance mechanism 3 have been fed out by the conveyance belt 30, the leading edges of the sheets P fed out enter the detection position of the sheet supply detection sensor 39 at time point tc, and the output of the sheet supply detection sensor 39 is turned on (paper present), whereby sheets P are detected. After the leading edges of the sheets P have reached the sheet supply detection sensor 39, feeding by the conveyance belt 30 is performed continuously. When a predetermined time has elapsed, the leading edges of the sheets P are sandwiched between the conveyance roller 37 and driven roller 38.

The control section S1 detects that the output of the sheet supply detection sensor 39 is turned on at time point tc and the leading edges of sheets P fed out by the conveyance belt 30 have reached the sheet supply detection sensor 39. After the lapse of the standby time predetermined with consideration given to the time required for the sheets P to be sandwiched between the conveyance roller 37 and driven roller 38, the control section S1 stops the rotation of the conveyance belt 30. In the meantime, the rotation of the conveyance roller 37 is still in progress.

When the output of the sheet supply detection sensor 39 is turned on at time point tc and the rotation of the conveyance belt 30 has stopped, the control section S1 checks the output of the sheet supply detection sensor 39 and determines that the sheet raising operation time point TU has been reached. For the operation of raising and suctioning the next sheet P, the control section S1 drives the solenoid 45 so that the sheet raising air outlet 40 is lowered to the sheet raising position.

Thus, the sheets P sandwiched between the conveyance roller 37 and driven roller 38 are conveyed at time t3. In the process of conveying the sheets P, the suction of the sheets P by the suction conveyance mechanism 3 is still in progress, and force is applied to allow the sheets P be to suctioned to the conveyance belt 30. However, this force is smaller than the force of conveyance by the conveyance roller 37 and driven roller 38 sandwiching the sheets P. Thus, the sheets P are pulled out while the conveyance belt 30 is kept stopped.

When the sheets P sandwiched between the conveyance roller 37 and driven roller 38 have been conveyed, the trailing edges of the sheets P pass through the suction detection sensor 6. When the trailing edges of the sheets P have passed through the suction detection sensor 6, the output of the suction detection sensor 6 is turned off (without suction) by the displacement of the detector 60 constituting the suction detection sensor 6, if sheets P are not suctioned on a continuous basis.

When the sheets P sandwiched between the conveyance roller 37 and driven roller 38 have been conveyed, the trailing edges of the sheets P pass through the sheet supply detection sensor 39. When the trailing edges of the sheets P have passed through the sheet supply detection sensor 39, the output of the sheet supply detection sensor 39 is turned off (without paper).

The control section S1 provides control in such a way that, when the output of the sheet supply detection sensor 39 has been turned off, the rotation of the conveyance roller 37 is stopped. Based on the output of the suction detection sensor 6 at the time when the output of the sheet supply detection sensor 39 has been turned off, the control section S1 determines whether or not the sheet separation time point TS has been reached when the sheet raising air outlet 40 is to be moved up to the separation position.

To be more specific, in the process of conveying sheets P, suction of sheets P by the suction conveyance mechanism 3 is still in progress. When the leading edges of the preceding sheets P have reached the sheet supply detection sensor 39, the sheet raising air outlet 40 is lowered to the sheet raising position, and the second sheet P may be suctioned to the conveyance belt 30 which is exposed in the middle of conveying the first preceding sheet P. However, as described above, if the leading edge of the first sheet P has been detected by the sheet supply detection sensor 39, the drive of the conveyance belt 30 is suspended at a predetermined time point. Thus, the second sheet P suctioned to the conveyance belt 30 is not conveyed in the middle of conveying the first sheet P.

Thus, at the time point td when the trailing edge of the first sheet P has passed through the suction detection sensor 6, the second sheet P has already been suctioned to the conveyance belt 30. The output of the suction detection sensor 6 may be kept turned on (suction performed) without being turned off during the time t4 from the passage of the trailing edge of the first sheet P through the sheet supply detection sensor 39 at time point te, to the turning off of the output of the sheet supply detection sensor 39.

In the aforementioned manner, conveyance of the preceding sheet P is followed by suction of the succeeding sheet P to the conveyance belt 30, whereby the output of the suction detection sensor 6 may remain unchanged. With consideration given to this possibility, the control section S1 uses the outputs of the suction detection sensor 6 and sheet supply detection sensor 39 to provide the elevation control of the sheet raising air outlet 40 and elevation control by the conveyance belt 30.

The trailing edges of the sheets P sandwiched between the conveyance roller 37 and driven roller 38 and conveyed pass through the sheet supply detection sensor 39, and the output of the sheet supply detection sensor 39 is turned off. When this procedure has been performed, the control section S1 assumes that the sheet separation time point TS has been reached if the output of the suction detection sensor 6 turns on, namely, if the next sheet P has already been suctioned to the conveyance belt 30. Then the control section S1 suspends the operation of the solenoid 45, and allows the sheet raising air outlet 40 to be moved up to the separation position.

When the sheets P are supplied on a continuous basis, the system goes to the step of preparing the next sheet supply if the trailing edges of the preceding sheets P have passed through the sheet supply detection sensor 39. If the next sheet P has already been suctioned to the conveyance belt 30, there is no need of raising the sheet again. Thus, when the trailing edges of the preceding sheets P have passed through the sheet supply detection sensor 39, the sheet raising air outlet 40 is immediately moved up to the separation position if the next sheet has already been suctioned to the conveyance belt 30.

By contrast, when the output of the sheet supply detection sensor 39 has been turned off, the control section S1 assumes that the sheet raising operation time point TU has been reached if the output of the suction detection sensor 6 is off, namely, if the next sheet P is not yet suctioned to the conveyance belt 30. The control section S1 allows the sheet raising air outlet 40 to be kept at the raising position until the next sheet P is suctioned to the conveyance belt 30 and the output of the suction detection sensor 6 is turned on.

Assume that the output of the suction detection sensor 6 is on when the output of the sheet supply detection sensor 39 has been turned off. In this case, the rotation of the conveyance belt 30 and conveyance roller 37 starts after the lapse of a predetermined separation standby time from the time when the output of the sheet supply detection sensor 39 has been turned off.

By contrast, assume that the output of the suction detection sensor 6 is off when the output of the sheet supply detection sensor 39 has been turned off. In this case, the rotation of the conveyance belt 30 and conveyance roller 37 starts after the lapse of a predetermined separation standby time from the time when the output of the suction detection sensor 6 has been turned on.

In the example of FIG. 6, the first sheet P sandwiched between the conveyance roller 37 and driven roller 38 is conveyed and the trailing edge of the first sheet P passes through the sheet supply detection sensor 39 at time point te. When the trailing edge of the first sheet P has passed through the sheet supply detection sensor 39 and the output of the sheet supply detection sensor 39 has been turned off, the system goes to the step of preparation for the supply of a second sheet P. When the output of the sheet supply detection sensor 39 has been turned off, the control section S1 stops the rotation of the conveyance roller 37. Further, since the output of the suction detection sensor 6 is on, the control section S1 turns off the operation of the solenoid 45 and moves the sheet raising air outlet 40 up to the separation position.

The second sheet P is already suctioned to the conveyance belt 30 at time point te. The time t5 is the sheet separation standby time for separation of the sheets P by the action of the sheet separation air A2 and sheet raising air A1 after the time point te when the output of the sheet supply detection sensor 39 is turned off.

At time point tf after the lapse of a predetermined sheet separation standby time t5 from passage of the first sheet P through the sheet supply detection sensor 39, the control section 51 rotates the conveyance belt 30 and conveyance roller 37, and starts to feed out the second sheet P.

When the second sheet P suctioned to the conveyance belt 30 has been fed out, the output of the sheet supply detection sensor 39 is turned on at time point tg. The control section detects that the leading edge of the second sheet P has reached the sheet supply detection sensor 39.

After detecting that the output of the sheet supply detection sensor 39 has been turned on at time point tg and the leading edges of sheets P fed out by the conveyance belt 30 has reached the sheet supply detection sensor 39, the control section S1 suspends the rotation of the conveyance belt 30, after the lapse of the standby time predetermined with consideration given to the time required for the sheet P to be sandwiched between the conveyance roller 37 and driven roller 38. In the meantime, the rotation of the conveyance roller 37 is still in progress. Thus, the sheets P sandwiched between the conveyance roller 37 and driven roller 38 are conveyed in time t6.

When the rotation of the conveyance belt 30 has been stopped, the control section S1 drives the solenoid 45 and lowers the sheet raising air outlet 40 to the sheet raising position so as to raise the next sheet P.

When the sheets P sandwiched between the conveyance roller 37 and driven roller 38 have been conveyed, the trailing edge of a second sheet P passes through the suction detection sensor 6 at time point th. When the trailing edge of the sheet P has passed by the suction detection sensor 6, the output of the suction detection sensor 6 is turned off (not suctioned) by the displacement of the detector 60 constituting the suction detection sensor 6, if not followed by the suction of a third sheet P to the conveyance belt 30. In this case, the trailing edge of the second sheet P has not yet reached the sheet supply detection sensor 39, and the output of the sheet supply detection sensor 39 is on.

When the second sheet P sandwiched between the conveyance roller 37 and driven roller 38 is further conveyed, the trailing edge of the second sheet P passes through the sheet supply detection sensor 39 at time point ti. When the trailing edge of the sheet P has passed through the sheet supply detection sensor 39, the output of the sheet supply detection sensor 39 is turned off.

When the second sheet P has passed through the sheet supply detection sensor 39, and the output of the sheet supply detection sensor 39 has been turned off, the control section S1 goes to the step of preparation for the supply of a third sheet P.

When the output of the sheet supply detection sensor 39 has been turned off, the control section S1 provides control to stop the rotation of the conveyance roller 37. Further, when the output of the sheet supply detection sensor 39 has been turned off, the control section S1 keeps the sheet raising air outlet 40 at the sheet raising position until the next sheet P is suctioned to the conveyance belt 30, and the output of the suction detection sensor 6 is turned on, if the output of the suction detection sensor 6 is off, namely when the next sheet P is not yet suctioned to the conveyance belt 30.

When the second sheet P has passed through the suction detection sensor 6, suction by the suction conveyance mechanism 3 is still in progress, and the sheet raising air A1 is being blasted from the sheet raising air outlet 40 having been lowered to the sheet raising position. Accordingly, third sheet P is suctioned to the conveyance belt 30. The times t7 and t8 indicate the raising and suction standby times from passage of the second sheet P through the suction detection sensor 6 to suction of a third sheet P, to the conveyance belt 30.

When the third sheet P has been suctioned to the conveyance belt 30 at time point tj, the detector 60 is detected by the suction detection sensor 6, whereby the output of the suction detection sensor 6 is turned on (sheet suctioned), and the control section S1 assumes that the sheet P has been suctioned to the conveyance belt 30.

When the output of the sheet supply detection sensor 39 is turned off, and the output of the suction detection sensor 6 has been turned on, the control section S1 stops the operation of the solenoid 45, and moves the sheet raising air outlet 40 up to the separation position. Then the control section S1 goes to the step of separation and conveyance of the third sheet P.

The third sheet P is suctioned to the conveyance belt, whereby the output of the suction detection sensor 6 is turned on. At time point tk after the lapse of a predetermined sheet separation standby time t9 from this time, the control section S1 drives the conveyance belt 30 and conveyance roller 37 to start feeding out of the third sheet P. After that, the aforementioned procedure is repeated.

Example of the Advantages of Sheet Supply Apparatus in the Present Embodiment In a structure wherein sheet raising air is blasted to the side of the sheets stacked on the sheet loading table so that the sheet is raised, if a raising air outlet is located above the upper side of the sheets stacked on the sheet loading table, the sheet raising air is not applied effectively to the side of the sheet, although a thin sheet can be raised. Thus, a thick paper cannot be raised easily.

By contrast, if the raising air outlet is located below the upper side of the sheets stacked on the sheet loading table, a thick paper can also be raised. In the case of thin sheets, however, the sheets tend to be raised as a bundle. Thus, the sheet raising air flows below a bundle of sheets suctioned to the conveyance belt. This makes it difficult to separate sheets from one another.

It is possible to roughly estimate the time duration from the start of blasting the sheet raising air, through raising of the sheet to the suction of the sheet to the conveyance belt. If the sheet conveyed can be detected, it is possible to assume that the sheet has been normally raised and has been suctioned to the conveyance belt. A technique has been proposed to provide a mechanism for moving the raising air outlet in the vertical direction and to move the raising air outlet in the vertical direction according to the control based on the estimated time and others.

In recent years, there has been an intense demand for diversification in the type of sheets to be handled. Particularly, the basis weight is required to meet a wider range of requirements. For example, it is essential to meet the requirements for supplying a great variety of sheets ranging from a thin sheet having a basis weight of 64 g/m$^2$ or less to an A3-sized thick sheet having a basis weight of 350 g/m$^2$ or more. However, there is a great difference between a thin sheet and thick paper in the mode of sheets raised by the sheet raising air. Even if the configuration and position of the raising air outlet have been optimized for a certain type of sheets, it has been impossible to meet simultaneously the requirements of both extremes as in sheet thickness.

In this situation, if the raising air outlet is moved in the vertical direction under estimated control, a problem will occur; for example, raising air outlet will be moved upward before sheets are suctioned to the conveyance belt, depending on the type of the sheets. This involves the possibility of causing errors wherein sheets will not be suctioned to the conveyance belt, or a plurality of sheets are fed out without being separated from one another in the case of a multiple feed error.

To solve this problem, the sheet supply apparatus 1A of the present embodiment controls the vertical movement of the sheet raising air outlet 40, based on the output of the suction detection sensor 6 that detects whether or not sheets P have been suctioned to the conveyance belt 30, and the output of the sheet supply detection sensor 39 that detects the sheets P being conveyed.

To be more specific, at the time point for sheet raising operation that can be determined from the outputs of the suction detection sensor 6 and sheet supply detection sensor 39, the sheet raising air outlet 40 is lowered to the sheet raising position and sheet raising air A1 is blasted to the side of the sheets stacked sheets P on the sheet loading table 2, whereby the sheets P can be positively raised and suctioned to the conveyance belt 30 even if these sheets P are thick paper. Further, this arrangement prevents the sheet raising air A1 from disturbing the raise of the sheet P without the sheet raising air outlet 40 moving to the separation position, when the sheet P is not suctioned to the conveyance belt 30. This arrangement also positive raising of various forms of sheets without having to reduce the height H1 that allows suction, the height H1 being formed between the upper side and conveyance belt 30 of the sheets P stacked on the sheet loading table 2. Thus, there is no deterioration in the separation performance resulting from reduction of the height H1 that allows suction. This arrangement also ensures positive raising of thick paper without having to increase the air volume of the fan that blasts the sheet raising air A1. This does not cause any increase in the size and cost of the apparatus.

At the sheet separation time point determined from the outputs of the suction detection sensor 6 and the sheet supply detection sensor 39, the sheet raising air outlet 40 is moved up to the separation position, and the sheet raising air A1 is blasted to the side of the sheets P suctioned to the conveyance belt 30. This ensures positive separation of the sheets P even if the sheets P are thin paper. Thus, suction failure or multiple feed errors can be prevented independently of the type of the sheet P. This arrangement also permits downsizing and cost reduction of the apparatus.

In the process of continuous sheet supply, the output of the suction detection sensor 6 may not undergo any change if sheets P are suctioned to the conveyance belt 30 on a continuous basis. This possibility has been taken in account in the design of the apparatus. Thus, the vertical movement of the sheet raising air outlet 40 is controlled based on the combination between the output of the sheet supply detection sensor 39 for detection of the position wherein the sheet P is conveyed, and the output of the suction detection sensor 6. This arrangement provides correct switching between the sheet raising operation time point and sheet separation time point, independently of the type of the sheets P.

Configuration Example of the Sheet Supply Unit in the Present Embodiment

Figure 7:
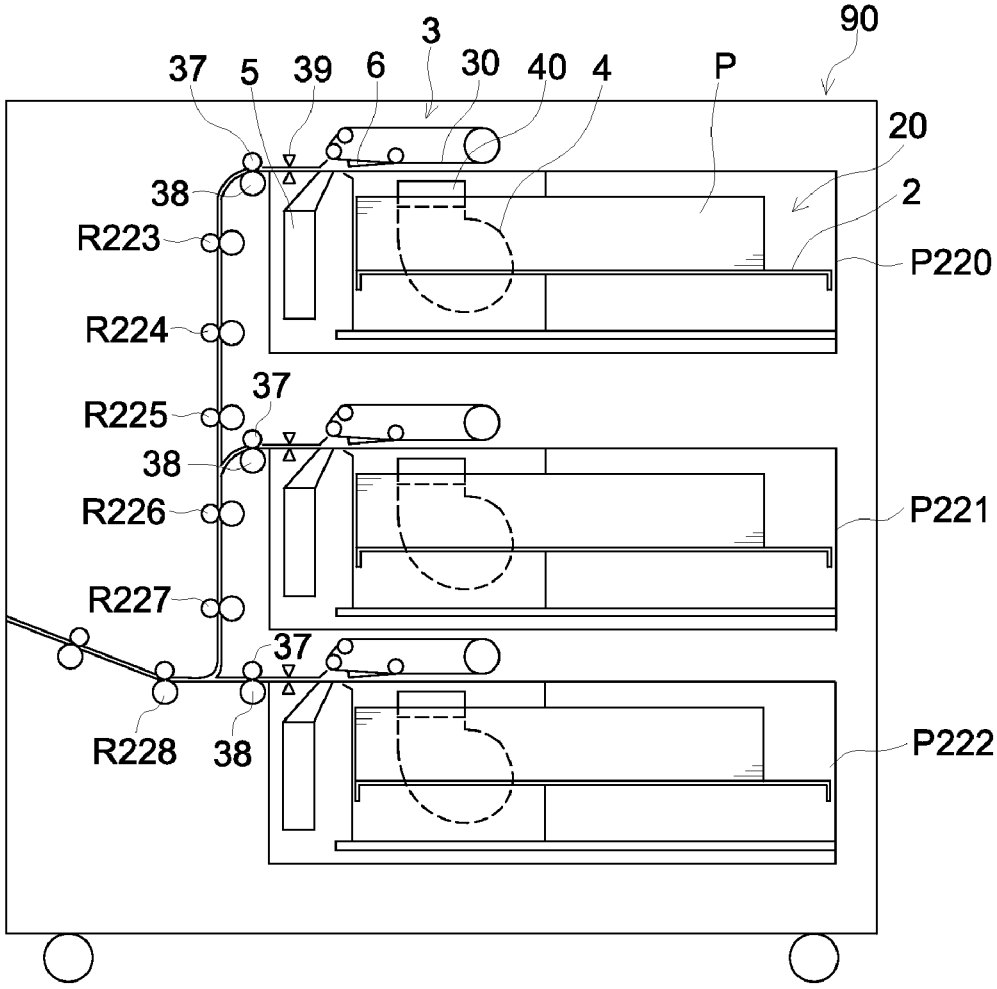
FIG. 7 is a schematic diagram showing an example of a sheet supply unit provided with the sheet supply apparatus in the present embodiment.

FIG. 7 is a schematic diagram showing an example of a sheet supply unit provided with the sheet supply apparatus in the present embodiment. The sheet supply unit 90 includes a plurality of sheet trays, and sheet trays P220, P221 and P222 (three in this example) constituting the sheet storage section 20 of FIG. 1, which are arranged in the vertical direction. Further, each of sheet trays P220, P221 and P222 is provided with a suction conveyance mechanism 3 containing a conveyance belt 30 or others of FIG. 1 and others.

A sheet raising air outlet 40 moved in the vertical direction by an outlet elevation mechanism not illustrated in FIG. 7 is mounted on each side of the sheet trays P220, P221 and P222. Further, a sheet raising air blast mechanism 4 is mounted to blast the sheet raising air to the side of the sheets P stacked on the sheet trays P220, P221 and P222. The suction conveyance mechanism 3 is provided with a separation air blast mechanism 5 that blasts sheet separation air between the first sheet at the topmost position and the second and later sheets when two or more sheets P have been suctioned. The sheet supply unit 90 is controlled by the control section of the image forming apparatus (to be described later). The sheet supply unit 90 can be equipped with a control section that provides the elevation control of the sheet raising air outlet 40, based on the outputs of the suction detection sensor 6 and output of the sheet supply detection sensor 39 described with reference to FIG. 1.

The sheet trays P220, P221 and P222 are provided so as to be pulled out in the longitudinal direction by opening the front door (not illustrated) mounted in the forward position of the drawing. It is also possible to arrange such a configuration that the front side of the sheet tray is formed as a exterior panel, which is provided with a grip and others to permit manual handling in such a way that sheet trays can be pulled in and out using the grip and others.

The sheets P are supplied by the suction conveyance mechanism 3 in the direction perpendicular to the direction wherein the sheet trays P220, P221 and P222 are pulled out (leftward in the drawing).

The sheets P suctioned to the conveyance belt 30 by the suction conveyance mechanism 3 are separated from one another by the action of the sheet raising air blasted from the sheet raising air blast mechanism 4 and the separation air blasted from the separation air blast mechanism 5. The sheet P fed out from the sheet tray P220 by the suction conveyance mechanism 3 is sandwiched between a pair of conveyance roller 37 and driven roller 38 provided with nip portions at almost the same height as the lower surface of the conveyance belt 30 wound on the driven roller on the lower side of the second driven roller group 33 of FIG. 1.

The sheet P sandwiched between the conveyance roller 37 and driven roller 38 is conveyed by the conveyance roller 37, and the direction of conveyance is changed by a guide member so that the sheet P will face downward. Then the sheet P is fed downward by the conveyance rollers R223 through R227 constituting the sheet conveyance path in the vertical direction. After the sheet P has been led to the left of the drawing in approximately the horizontal direction, the leading edge of the sheet P is made to abut on the conveyance roller R228 whose rotation is stopped, whereby the sheet P is stopped.

The conveyance roller R228 serves as a registration roller to be synchronized with the image forming process in the image forming apparatus 10 to be described later. After that, the sheet P is fed into the image forming apparatus by the start of rotation of the conveyance roller 228 and others.

Similarly, the sheet P fed out from the sheet tray P221 by the suction conveyance mechanism 3 is sandwiched between a pair of conveyance roller 37 and driven roller 38 provided with nip portions at almost the same height as the lower surface of the conveyance belt 30 wound on the driven roller on the lower side of the second driven roller group 33 of FIG. 1.

The sheet P sandwiched between a pair of conveyance roller 37 and driven roller 38 is conveyed by the conveyance roller 37, and the direction of conveyance is changed by a guide member so that the sheet P will face downward. Then the sheet P is fed downward by the conveyance rollers R226 through R227. After the sheet P has been led to the left of the drawing in approximately the horizontal direction, the leading edge of the sheet P is made to abut on the conveyance roller R228 whose rotation is stopped, whereby the sheet P is stopped. Then the sheet P is fed into the image forming apparatus by the start of rotation of the conveyance roller 228.

Further, the sheet P fed out from the sheet tray P222 by the suction conveyance mechanism 3 is sandwiched between a pair of conveyance roller 37 and driven roller 38 provided with nip portions at almost the same height as the lower surface of the conveyance belt 30 wound on the driven roller on the lower side of the second driven roller group 33 of FIG. 1.

The sheet P sandwiched between a pair of conveyance roller 37 and driven roller 38 is conveyed by the conveyance roller 37. The leading edge of the sheet P is made to abut on the conveyance roller R228 whose rotation is stopped, whereby the sheet P is stopped. Then the sheet P is fed into the image forming apparatus by the start of rotation of the conveyance roller 228.

Figure 8:
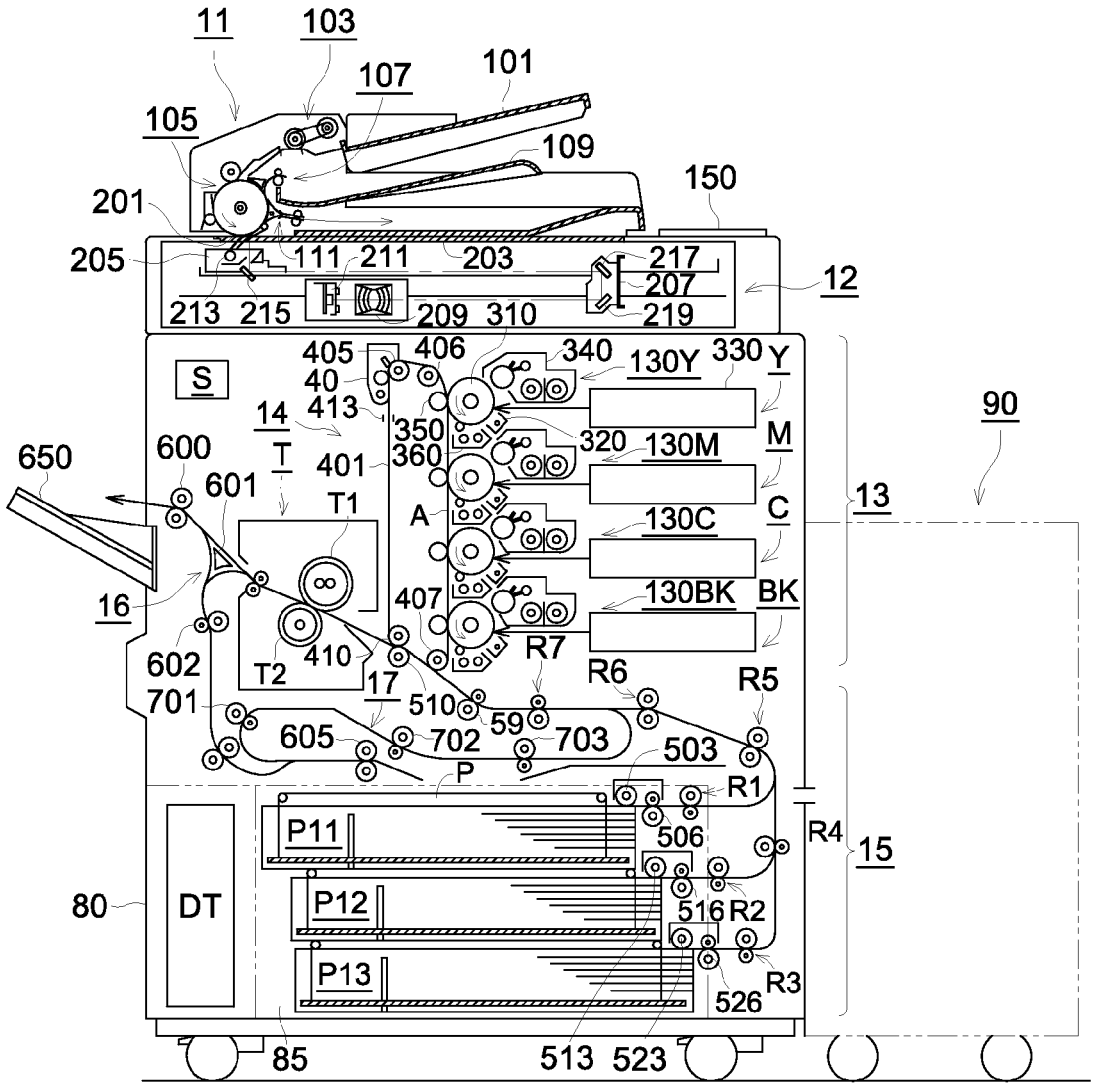
FIG. 8 is a schematic diagram showing an example of an image forming apparatus connected with the sheet supply unit provided with the sheet supply apparatus in the present embodiment.

Configuration Example of the Image Forming Apparatus in the Present Embodiment FIG. 8 is a schematic diagram showing an example of an image forming apparatus connected with the sheet supply unit provided with the sheet supply apparatus in the present embodiment. For example, in a digital color photocopier, the image forming apparatus 10 includes an automatic document feeder 11 installed on the top of the main unit of the apparatus, and incorporates an image reading section 12, image forming section 13, belt unit 14, sheet supply section 15, fixing apparatus T, reverse ejection section 16, and sheet re-supply section 17.

The automatic document feeder 11 feeds the documents one by one to the image reading position, and ejects the documents to a document ejection tray after the image thereon have been read.

The automatic document feeder 11 includes a document placement tray 101, document separation section 103, document transfer section 105, document ejection section 107, document ejection tray 109, and document reversing roller 111 that reverses documents.

A plurality of documents placed on the document placement tray 101 are separated from one another by the document separation section 103, and are conveyed to the image reading position through a document transfer section 105.

The document reading position is found downstream of the document transfer section 105, and the image on the document is read through the slit 120 of the image reading section 12. After that, the document is ejected onto the document ejection tray 109 by the document ejection section 107. In the duplex reading mode, the document wherein one of the sides has been read is fed by the document reversing roller 111 in the direction indicated by the two-dot chain line arrow.

The trailing edge of the document traveling in the forward direction is sandwiched and the document is stopped in this condition. After that, the document is again conveyed to the image reading position by the reverse rotation of the document reversing roller 111 through the document transfer section 105. Then the document is ejected to the document ejection tray 109 by the document ejection section 107.

The aforementioned process is repeated for a plurality of documents placed on the document placement tray 101.

The image reading section 12 includes:

the aforementioned slit 201;

a first mirror unit 205 made up of an integration of a document illumination lamp 213 and a first mirror 215 for reflecting the light from the document; and a second mirror unit 207 made up of an integration of a second mirror 217 and a third mirror 219.

The image reading section 12 also includes an imaging lens 209 for forming an image on the image pickup element using the light reflected from the third mirror 219, and a linear image pickup element (hereinafter referred to as "CCD") for obtaining image information by photoelectric conversion of the optical image formed by the imaging lens 209.

In the arrangement wherein the document conveyed by the automatic document feeder 11 is read by the image reading section 12, the first mirror unit 205 and second mirror unit 207 are fixed at the illustrated position.

After having been subjected to appropriate image processing, the image information read by the image reading section 12 is stored in the memory of the control section. The image information of each color read by the mage reading section 12 and stored in the memory is sequentially read from the memory, and is transmitted as an electric signal to the image forming section 13 of each color.

The image forming section 13 is provided with a total of four image forming units 130 (130Y, 130M, 130C and 130BK) of yellow (Y), magenta (M), cyan (C), black (BK) for forming a toner image in response to each color decomposed image.

Each of the mage forming units 130 is a photoreceptor 310 with a photosensitive layer mounted on the drum-like metallic substrate, a charging device 320, an exposure optical system 330 as an image writing device, a development apparatus 340, a primary transfer section 350 and a cleaning section 360 as major components. The exposure optical system 330 is an exposure unit composed of a laser optical system.

In FIG. 8, reference numerals are assigned only to the members constituting the yellow (Y) image forming unit. Other image forming units having the same structure will not be assigned with reference numeral.

The development apparatus 340 incorporates a two-component developer containing a carrier and toner. The development apparatus 340 is provided with a cylindrical non-magnetic development sleeve for containing plurality of fixed magnets, a developer storage section and a toner density detecting sensor.

The developer is carried magnetically by a plurality of magnets on the development sleeve, and is conveyed to the development area by the rotation of this development sleeve. Then the developer having been subjected to development processing is removed from the development sleeve by repulsive magnetic field. A bias voltage obtained by superimposition of the direct and alternating currents of a predetermined polarity (negative in this case) is applied to the development sleeve.

The primary transfer section 350 is made of a primary transfer roller opposed to the peripheral surface of the photoreceptor 310 through the intermediate transfer belt 401.

The cleaning section 360 removes the toner remaining on the photoreceptor 310 subsequent to primary transfer, and the removed toner is stored in the waste toner box DT installed on the side of the sheet tray.

The image forming units 130 of various color are installed in the order of yellow (Y), magenta (M), cyan (C) and black (BK) counted from the top, in the forward direction of one plane surface A of the intermediate transfer belt 401 mounted in the longitudinal direction.

The belt unit 14 includes the aforementioned intermediate transfer belt 401, the supporting rollers 405, 406 and 407 for supporting this intermediate transfer belt, and a backup roller 410.

Further, the secondary transfer section is formed by a transfer roller 510 and a backup roller 410 that is arranged opposed thereto with an intermediate transfer belt 401 sandwiched in-between and is rotated in the state pressed against the transfer roller 510.

The image forming process in the image forming apparatus 10 is performed as follows: The surface of the photoreceptor 310 rotating in the counterclockwise direction in the drawing is charged to have a predetermined polarity (negatively charged in this case) by the charging device 320.

Exposure corresponding to the first color signal—i.e., yellow (Y) image signal—is provided by the exposure optical system 330. Then a latent image corresponding to the yellow (Y) image is formed on the photoreceptor 310.

The latent image of the photoreceptor 310 is reverse-developed in contact or non-contact mode by the developer of the development apparatus 340. After a yellow (Y) toner image is formed on the photoreceptor 310, the image is primarily transferred onto the intermediate transfer belt 401 by the primary transfer section 350.

Similarly to the case of the yellow color, the image forming units 130 of magenta (M), cyan (C), and black (BK) are used to perform the image forming processes which are sequentially started according to other color signals after the lapse of a predetermined time from the start of formation of an image according to the first color signal.

The toner images of various colors formed on the photoreceptor 310 of various colors are superimposed on the intermediate transfer belt 401, and are secondarily transferred. A color toner image is formed on the intermediate transfer belt 401. In the meantime, the surface of the photoreceptor 310 subsequent to the process of primary transfer is cleaned by a cleaning section 360.

Timing to start the individual image forming process for the photoreceptor 310 or intermediate transfer belt 401 is determined as follows: A registration sensor 413 is provided in the area outside the intermediate transfer belt 401 ranging from the position of the transfer roller 510 to the position of the yellow image forming unit, as viewed from the rotating direction of the intermediate transfer belt.

Time is counted from the time point when the reference mark placed on the intermediate transfer belt 401 has been detected by the registration sensor 413, and image forming processes of (Y), (M), (C), (BK) are performed in that order at every predetermined time interval.

The control section S includes a CPU for processing computation control, a ROM for storing various forms of programs, and a RAM for storing various forms of data, and takes charge of all the control of a series of image forming processes. Based on the outputs of the suction detection sensor 6 and the sheet supply detection sensor 39 described with reference to FIG. 1, the control section S controls the vertical traveling of the sheet raising air outlet 40 of the sheet supply unit 90.

The image forming apparatus 10 has a total of three sheet trays P11, P12 and P13 mounted on the lower portion of the main unit of the apparatus. Each of the sheet trays P11, P12 and P13 can be provided with a suction conveyance mechanism 3 having the aforementioned conveyance belt 30, a sheet raising air blast mechanism 4, and a separation air blast mechanism 5. Based on the outputs of the suction detection sensor 6 and the sheet supply detection sensor 39 described with reference to FIG. 1, the control section S1 controls the vertical traveling of the sheet raising air outlet 40 provided on each of the sheet trays P11, P12 and P13. Each of the sheet trays P11, P12 and P13 can be pulled out in the forward direction of the drawing.

The sheet trays P11, P12 and P13 include the sheet supply rollers 503, 513 and 523, separation rollers 506, 516 and 526, and conveyance roller R1, R2, R3. The sheet P fed out by these rollers is conveyed by the conveyance rollers R4 through R7.

The registration roller 59 is located downstream of the conveyance roller R7 and in close proximity to the secondary transfer section. A fixing apparatus T containing a fixing roller T1 incorporating a heat source and a pressure roller T2 rotating in close contact with the fixing roller T1 is mounted downstream of the secondary transfer section on the conveyance path.

The ejection roller 600 ejects the sheet P wherein an image is formed. Sheets P ejected by the ejection roller 600 are stacked on the ejection tray 650.

The reverse ejection section 16 reverses and conveys the ejected sheets P. The sheet re-supply section 17 reverses and conveys the sheet having an image formed on one side thereof, and re-supplies the sheet to the registration roller 59.

The following describes the structure of the apparatus and others in connection with the processes wherein the color toner image formed on the intermediate transfer belt 401 is transferred onto the sheet, which is then ejected out of the apparatus.

At appropriate time intervals corresponding to the formation of an image on the intermediate transfer belt 401, sheets P are supplied by the sheet supply roller 503 (513, 523). The sheets P to be supplied are those having the size selected on the operation display section 150 wherein the number of sheets, startup button, magnification or image density, and such related items can be set. These sheets P are supplied from the sheet trays P11, P12 and P13 inside the apparatus or sheet trays P220, P221 and P222 of the sheet supply unit 90.

The sheets P are sandwiched between the separation roller 506, and a plurality of conveyance rollers R1 through R7 provided on the conveyance path, and are conveyed to the registration roller 59 located downstream of the secondary transfer section.

After the leading edges have been made to abut on the registration roller 59, the sheets P are supplied with the restart of the rotation of the registration roller 59 at time intervals when there is superimposition with the color toner image area on the intermediate transfer belt 401.

In the secondary transfer section, the sheets P together with the intermediate transfer belt 401 are sandwiched between the backup roller 410 and transfer roller 510. In the meantime, the color toner image on the intermediate transfer belt 401 is secondarily transferred onto the sheets P. In the process of secondary transfer, a predetermined transfer bias voltage is preferably applied to the transfer roller 510. The sheets P with the color toner image transferred thereon are separated from the intermediate transfer belt 401, and are conveyed to the fixing apparatus T by a conveyance belt (not illustrated). The color toner is molten by heat and pressure, and is fixed on the sheets P.

After having been subjected to the fixing process by the fixing apparatus T, the sheets P are transferred by the ejection roller 600 provided downstream, and are ejected onto the ejection tray 650 outside the main unit of the apparatus. In the meantime, the surface of the intermediate transfer belt 401 after the process of secondary transfer is cleaned by the cleaning section 360, and the next color toner image transfer process is implemented.

In FIG. 8, the switching member 601 is positioned wherein sheets P are ejected without being reversed subsequent to the fixing process. When the sheets P are reversed and ejected, the witching member 601 is rotated by a predetermined amount, and the sheets P subsequent to the fixing process are led downward along the right side of the switching member 601.

After the sheets P have been stopped with the trailing edges thereof being sandwiched by the reversing roller 602, the sheets P are moved upward along the left side of the switching member 601 by the reverse rotation of the reversing roller 602, and are ejected through the ejection roller 600.

In the duplex copy mode using the sheet re-supply section 17, the sheets P having been subjected to the fixing process wherein an image is formed on one side are led downward along the right side of the switching member 601. The sheets P are then stopped with the trailing edges of the sheets P being sandwiched by the reversing roller 605.

Then the reversing roller 605 is reverse-rotated, and is moved upward along the guide plate (not illustrated). The sheets P having been conveyed to a plurality of rollers 701, 702 and 703 are reversed and conveyed.

The image forming process on the second surfaces of the sheets P is performed as described above. After the sheets P have been fed out of the fixing apparatus T, any one of the aforementioned ejection routes is selected. In the meantime, the toner having been removed from the surface of the photoreceptor by the cleaning section 360 is fed to the waste toner box DT and is accommodated therein.

The embodiment of the present invention has been described with reference to the image forming apparatus for forming a color image. It is to be noted, however, that the above description is also applicable to an image forming apparatus for forming a monochromatic image.

INDUSTRIAL FIELD OF APPLICATION

The present invention is applied to the image forming apparatus provided with the sheet supply apparatus wherein stacked sheets are raised by air and suctioned to a conveyance belt.

EFFECTS OF THE INVENTION

According to the sheet supply apparatus of the present embodiment, air is blasted to the side of the sheets stacked on a sheet loading table until sheets are suctioned to the suction surface, and the sheets can be suctioned to the suction surface. This arrangement prevents suction failure wherein sheets P are not suctioned to the suction surface.

After the sheets have been suctioned to the suction surface, air is blasted from the sides of the sheets suctioned to the suction surface. When a plurality of sheets has been raised, air is blasted to separate a plurality of sheets from the one sheet at the topmost position suctioned to the suction surface.

This arrangement prevents the occurrence of a multiple feed error wherein a plurality of sheets kept suctioned to the absorption surface are conveyed.

According to the sheet supply unit of the present embodiment, the aforementioned sheet supply apparatus is provided to prevent the occurrence of a suction error wherein sheets cannot be suctioned to the suction surface, as well as the occurrence of a multiple feed error wherein a plurality of sheets kept suctioned to the absorption surface are conveyed. According to the image forming apparatus of the present invention, the aforementioned sheet supply apparatus is provided to prevent the occurrence of a suction error wherein sheets cannot be suctioned to the suction surface, as well as the occurrence of a multiple feed error wherein a plurality of sheets kept suctioned to the absorption surface are conveyed. Thus, enhanced image quality is ensured by this arrangement.

What is claimed is:

1. A sheet supply apparatus comprising:

a sheet loading table on which a plurality of sheets are stacked, wherein the sheet loading table moves up and down along a stacking direction of the plurality of sheets;

a suction conveyance mechanism which suctions a topmost sheet of the plurality of sheets stacked on the sheet loading table onto an suction surface by suctioning a top surface of the stacked sheets and conveys the suctioned sheet to a sheet conveyance path;

an air blast mechanism which comprises an air outlet which movies up and down along a direction in which a sheet of the stacked sheets on the sheet loading table are floated up toward the sheet suction surface and blasts air toward a side of the stacked sheets from the air outlet;

an outlet elevation mechanism which moves the air outlet to and from a first position at which the air outlet faces the side of the stacked sheets on the sheet loading table and a second position at which the air outlet faces a side of the sheet suctioned onto the suction surface;

a suction detection sensor which detects whether a sheet is suctioned to the suction surface or not;

a sheet supply detection sensor which detects a sheet being conveyed by the suction conveyance mechanism; and a control section which judges a sheet raising operation time point when the sheets stacked on the sheet loading table are floated up and a sheet separation time point when the sheet suctioned to the suction surface is separated, based on a presence or non presence of the sheet suctioned to the suction face detected by the suction detection sensor and a conveyance position of the sheet detected by the sheet supply detection sensor, and moves the air outlet to the first position at the sheet raising operation time point and to the second position at the sheet separation time point by controlling the outlet elevation mechanism, based on the judgments of the operation time points.

2. The sheet supply apparatus of claim 1, wherein the control section judges that the sheet separation time point has come and moves the air outlet to the second point, when the suction detection sensor detects that the sheet comes to be suctioned from not suctioned to the suction surface, or when the sheet comes to be not detected by the sheet supply detection sensor while the suction detection sensor detects that the sheet is suctioned to the suction surface; and the control section judges that the sheet raising operation time point has come and moves the air outlet to the first point, when the suction detection sensor detects that the sheet is not yet suctioned to the suction surface, or when the sheet supply detection sensor detects the sheet while the suction detection sensor detects that the sheet is suctioned to the suction surface.

3. The sheet supply apparatus of claim 1, comprising a sheet holding member at an upper position of the air outlet, the sheet holding member projecting from the air outlet with a predetermined length so as to come in contact with a side of the sheet floated by the air blasted from the air outlet.

4. A sheet supply unit comprising:

a sheet loading table on which a plurality of sheets are stacked, wherein the sheet loading table moves up and down along a stacking direction of the plurality of sheets;

a suction conveyance mechanism which suctions a topmost sheet of the plurality of sheets stacked on the sheet loading table onto a suction surface by suctioning a top surface of the stacked sheets and conveys the suctioned sheet to a sheet conveyance path;

an air blast mechanism which comprises an air outlet which movies up and down along a direction in which a sheet of the stacked sheets on the sheet loading table are floated up toward the sheet suction surface and blasts air toward a side of the stacked sheets from the air outlet;

an outlet elevation mechanism which moves the air outlet to and from a first position at which the air outlet faces the side of the stacked sheets on the sheet loading table and a second position at which the air outlet faces a side of the sheet suctioned onto the suction surface;

a suction detection sensor which detects whether a sheet is suctioned to the suction surface or not;

a sheet supply detection sensor which detects a sheet being conveyed by the suction conveyance mechanism; and a control section which judges a sheet raising operation time point when the sheets stacked on the sheet loading table are floated up and a sheet separation time point when the sheet suctioned to the suction surface is separated, based on a presence or non presence of the sheet suctioned to the suction face detected by the suction detection sensor and a conveyance position of the sheet detected by the sheet supply detection sensor, and moves the air outlet to the first position at the sheet raising operation time point and to the second position at the sheet separation time point by controlling the outlet elevation mechanism, based on the judgments of the operation time points.

5. The sheet supply unit of claim 4, wherein the control section judges that the sheet separation time point has come and moves the air outlet to the second point, when the suction detection sensor detects that the sheet comes to be suctioned from not suctioned to the suction surface, or when the sheet comes to be not detected by the sheet supply detection sensor while the suction detection sensor detects that the sheet is suctioned to the suction surface; and the control section judges that the sheet raising operation time point has come and moves the air outlet to the first point, when the suction detection sensor detects that the sheet is not yet suctioned to the suction surface, or when the sheet supply detection sensor detects the sheet while the suction detection sensor detects that the sheet is suctioned to the suction surface.

6. The sheet supply unit of claim 4, comprising a sheet holding member at an upper position of the air outlet, the sheet holding member projecting from the air outlet with a predetermined length so as to come in contact with a side of the sheet floated by the air blasted from the air outlet.

7. An image forming apparatus comprising:

an image forming section for forming image on a sheet;

a sheet supply apparatus for supplying a sheet to the image forming section; and a control section which executes a control to supply a sheet from the sheet supply apparatus to the image forming section and form image at the image forming section, wherein the sheet supply section comprises:

a sheet loading table on which a plurality of sheets are stacked, wherein the sheet loading table moves up and down along a stacking direction of the plurality of sheets;

a suction conveyance mechanism which suctions a topmost sheet of the plurality of sheets stacked on the sheet loading table onto a suction surface by suctioning a top surface of the stacked sheets and conveys the suctioned sheet to a sheet conveyance path;

an air blast mechanism which comprises an air outlet which movies up and down along a direction in which a sheet of the stacked sheets on the sheet loading table are floated up toward the sheet suction surface and blasts air toward a side of the stacked sheets from the air outlet;

an outlet elevation mechanism which moves the air outlet to and from a first position at which the air outlet faces the side of the stacked sheets on the sheet loading table and a second position at which the air outlet faces a side of the sheet suctioned onto the suction surface;

a suction detection sensor which detects whether a sheet is suctioned to the suction surface or not; and a sheet supply detection sensor which detects a sheet being conveyed by the suction conveyance mechanism, wherein the control section judges a sheet raising operation time point when the sheets stacked on the sheet loading table are floated up and a sheet separation time point when the sheet suctioned to the suction surface is separated, based on a presence or non presence of the sheet suctioned to the suction face detected by the suction detection sensor and a conveyance position of the sheet detected by the sheet supply detection sensor, and moves the air outlet to the first position at the sheet raising operation time point and to the second position at the sheet separation time point by controlling the outlet elevation mechanism, based on the judgments of the operation time points.

8. The image forming apparatus of claim 7, wherein the control section judges that the sheet separation time point has come and moves the air outlet to the second point, when the suction detection sensor detects that the sheet comes to be suctioned from not suctioned to the suction surface, or when the sheet comes to be not detected by the sheet supply detection sensor while the suction detection sensor detects that the sheet is suctioned to the suction surface; and the control section judges that the sheet raising operation time point has come and moves the air outlet to the first point, when the suction detection sensor detects that the sheet is not yet suctioned to the suction surface, or when the sheet supply detection sensor detects the sheet while the suction detection sensor detects that the sheet is suctioned to the suction surface.

9. The image forming apparatus of claim 7, comprising a sheet holding member at an upper position of the air outlet, the sheet holding member projecting from the air outlet with a predetermined length so as to come in contact with a side of the sheet floated by the air blasted from the air outlet.

* * * * *